US008991207B2

(12) United States Patent
Takayama et al.

(10) Patent No.: US 8,991,207 B2
(45) Date of Patent: Mar. 31, 2015

(54) REFRIGERATING CYCLE APPARATUS AND AIR CONDITIONING APPARATUS

(75) Inventors: Keisuke Takayama, Chiyoda-ku (JP); Yusuke Shimazu, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 448 days.

(21) Appl. No.: 13/059,331

(22) PCT Filed: Mar. 13, 2009

(86) PCT No.: PCT/JP2009/054844
§ 371 (c)(1),
(2), (4) Date: Feb. 16, 2011

(87) PCT Pub. No.: WO2010/029781
PCT Pub. Date: Mar. 18, 2010

(65) Prior Publication Data

US 2011/0138835 A1 Jun. 16, 2011

(30) Foreign Application Priority Data

Sep. 12, 2008 (JP) ..... 2008-235384

(51) Int. Cl.
*F25B 1/10* (2006.01)
*F25B 9/06* (2006.01)
(Continued)

(52) U.S. Cl.
CPC ... *F25B 9/06* (2013.01); *F24F 1/42* (2013.01); *F24F 13/222* (2013.01);
(Continued)

(58) Field of Classification Search
USPC ..... 62/305, 91, 121, 510
See application file for complete search history.

(56) References Cited

U.S. PATENT DOCUMENTS 4,938,035 A * 7/1990 Dinh ..... 62/279
6,018,954 A * 2/2000 Assaf ..... 62/94
(Continued)

FOREIGN PATENT DOCUMENTS

JP 11-094379 A 4/1999
JP 11094379 A * 4/1999
(Continued)

OTHER PUBLICATIONS

Office Action issued on May 24, 2012 by the Chinese Patent Office in corresponding Chinese Patent Application No. 200980135438.8, and an English translation of the main text.
(Continued)

*Primary Examiner* — Mohammad M Ali
*Assistant Examiner* — Raheena Rehman
(74) *Attorney, Agent, or Firm* — Buchanan Ingersoll & Rooney PC

(57) ABSTRACT

To provide a refrigerating cycle apparatus capable of improving cooling ability by water spray to perform an efficient operation while suppressing decrease in collected power by an expander. The refrigerating cycle apparatus includes: a first compressor that compresses the refrigerant; an expander that decompresses and expands the refrigerant to collect power for expansion; a second compressor that is driven by the power collected by the expander to further compresses the refrigerant compressed by the first compressor to transmit it to a main radiator; a heat exchanger having an intercooler that cools the refrigerant compressed by the first compressor and a main radiator that cools the refrigerant compressed by the second heat exchanger to transmit it to the expander; indoor heat exchangers that heat the refrigerant decompressed by the expander; and a water spray apparatus that sprays water onto the outer surface of the intercooler and the main radiator. The water spray apparatus sprays water such that the water spray amount per heat transfer area of the intercooler becomes larger than that of the main radiator.

6 Claims, 5 Drawing Sheets

(51) Int. Cl.

| | |
|---|---|
| ***F24F 1/42*** | (2011.01) |
| ***F24F 13/22*** | (2006.01) |
| ***F25B 9/00*** | (2006.01) |
| ***F25B 13/00*** | (2006.01) |

(52) U.S. Cl.

CPC ..... *F24F 2013/225* (2013.01); *F25B 1/10* (2013.01); *F25B 9/008* (2013.01); *F25B 13/00* (2013.01); *F25B 2309/061* (2013.01); *F25B 2313/02741* (2013.01); *F25B 2339/041* (2013.01); *F25B 2400/04* (2013.01)

USPC ..... 62/510; 62/91; 62/121; 62/305

(56) References Cited

U.S. PATENT DOCUMENTS

| | | | | |
|---|---|---|---|---|
| 6,047,555 | A * | 4/2000 | Weng | 62/171 |
| 6,465,750 | B1 * | 10/2002 | Rubenstein | 200/43.21 |
| 6,584,789 | B2 * | 7/2003 | Ishikawa | 62/171 |
| 6,658,888 | B2 * | 12/2003 | Manohar et al. | 62/498 |
| 6,698,234 | B2 * | 3/2004 | Gopalnarayanan et al. | 62/505 |
| 7,063,906 | B2 * | 6/2006 | Matthews et al. | 429/430 |
| 2005/0193763 | A1 * | 9/2005 | Alford et al. | 62/510 |
| 2008/0256975 | A1 * | 10/2008 | Lifson et al. | 62/510 |
| 2010/0170295 | A1 * | 7/2010 | Okazaki et al. | 62/510 |

FOREIGN PATENT DOCUMENTS

| | | | | |
|---|---|---|---|---|
| JP | 2003-279179 | A | | 10/2003 |
| JP | 2006-162226 | A | | 6/2006 |
| JP | 2006-308166 | A | | 11/2006 |
| JP | 2006308166 | A | * | 11/2006 |
| JP | 2008-075949 | A | | 4/2008 |
| WO | WO 2008024102 | A1 | * | 2/2008 |
| WO | WO 2008146709 | A1 | * | 12/2008 |

OTHER PUBLICATIONS

International Search Report (PCT/ISA/210) issued on May 18, 2009, by Japanese Patent Office as the International Searching Authority for International Application No. 2009-054844.

Office Action from Japanese Patent Office issued in corresponding Japanese Patent Application No. 2008-235384 dated Jan. 11, 2011, with an English translation thereof.

Office Action (Notification of the Second Office Action) dated Nov. 27, 2012, issued by the Chinese Patent Office in the corresponding Chinese Patent Application No. 200980135438.8 and an English translation thereof. (7 pages).

* cited by examiner

REFRIGERATING CYCLE APPARATUS AND AIR CONDITIONING APPARATUS

TECHNICAL FIELD

The present invention relates to a refrigerating cycle apparatus whose refrigerant is a fluid to be a supercritical state, more particularly to the configuration of the refrigerating cycle apparatus and the air conditioning apparatus using an expander.

BACKGROUND ART

Conventionally, a refrigerating cycle apparatus utilizing an expander is known that uses a fluid to be a supercritical state as a refrigerant to improve COP (Coefficient of Performance: energy consumption efficiency) by spraying water over part of the surface of a heat source side heat exchanger or a load side heat exchanger.

For example, there is a refrigerating cycle apparatus, in which a refrigerant circuit is configured by connecting a compressor, a flow path switching means, a heat source side heat exchanger, and a load side heat exchanger, and including a water spray apparatus that sprays water onto the surface of part of a heat source side heat exchanger or part of a load side heat exchanger. It is arranged that water can be sprayed onto part of the heat source side heat exchanger or the load side heat exchanger where a high-pressure refrigerant discharged from the compressor passes. (refer to Patent Literature 1, for example)

When applied to an air conditioning apparatus, the temperature of the refrigerant can be lowered by cooling the refrigerant by spraying water at the outlet of the heat source side heat exchanger in the cooling operation. The performance can be improved by increasing the difference of enthalpy in an evaporator to be a load side heat exchanger.

As another example of the refrigerating cycle apparatus using the expander, some refrigerating cycle apparatus includes water spray means that sprays water to improve the COP.

For example, with the refrigerating cycle apparatus that constitutes a refrigerant circuit by connecting the compressor, the heat source side heat exchanger, the expander, and the load side heat exchanger, the heat source side heat exchanger is disposed outdoors to make outdoor air and the refrigerant to perform heat exchange. On the other hand, the load side heat exchanger is disposed indoors to make indoor air and the refrigerant to perform heat exchange. In the cooling operation in which the heat source side heat exchanger is used as a radiator, water spray means sprays water all over the surface of the heat source side heat exchanger. (Refer to Patent Literature 2)

In the cooling operation, when spraying water on the heat source side heat exchanger that radiates heat on the refrigerant side, water absorbs heat from the refrigerant to evaporate. Accordingly, the heat radiation amount from the refrigerant can be increased for as much as evaporation latent heat of the water, allowing to decrease the enthalpy of the refrigerant transmitted to the load side heat exchanger. Excessive water spray is suppressed by adjusting the water spray amount.

CITATION LIST

Patent Literature

Patent Literature 1: Japanese Unexamined Patent Application Publication No. 2006-308166 (claim 11, FIG. 5, etc.)

Patent Literature 2: Japanese Unexamined Patent Application Publication No. 2006-162226 (claim 1, etc.)

SUMMARY OF INVENTION

Technical Problem

For example, there is a refrigerating cycle apparatus that includes not only the first compressor but also the second compressor that compresses the refrigerant by power collected by the expander and the heat source side heat exchanger is constituted by an intercooler that cools the refrigerant discharged from the first compressor and a main radiator that cools the refrigerant discharged from the second compressor. In such a refrigerating cycle apparatus, when water is sprayed only on the main radiator, which is the outlet side of the heat source side heat exchanger, the difference in pressure between inlet and outlet of the expander becomes small, resulting in the decrease in the power collectable by the expander. Therefore, in the configuration like Patent Literature 1, the power collected by the expander is lowered to cause the decrease in compression work of the second compressor. In the case where water is sprayed on all over the surface of the heat source side heat exchanger like Patent Literature 2, adjustment of the spray water amount for maintaining the power to be collected in the expander reduces the effect to improve cooling ability of the heat source side heat exchanger by spraying water.

The present invention is made to solve the above-mentioned problems and its object is to provide a refrigerating cycle apparatus that improves cooling ability by water spray while suppressing decrease in collection power by the compressor to perform an efficient operation in the refrigerating cycle apparatus that performs two-stage compression using collection power by the compressor.

Solution to Problem

The refrigerating cycle apparatus according to the present invention includes: a first compressor that compresses the refrigerant; an expander that decompress and expands the refrigerant to collect power for expansion; a second compressor that is driven by the power collected by the expander to further compresses the refrigerant compressed by the first compressor; a heat exchanger having an intercooler that cools the refrigerant compressed by the first compressor and a main radiator that cools the refrigerant compressed by the second heat exchanger to transmit it to the expander; an evaporator that heats the refrigerant decompressed by the expander; and a water spray apparatus that sprays water onto the outer surface of the intercooler and the main radiator. The water spray apparatus sprays water such that the water spray amount per a heat transfer area of the intercooler is larger than that of the main radiator.

Advantageous Effects of Invention

With the present invention, it is possible to improve heat radiation effect by making the water spray amount per heat transfer area for the heat source side heat exchanger of the intercooler larger than that of the main radiator because the refrigerant can radiate heat to the latent heat of the air and the evaporating water in the intercooler in particular. Accordingly, it is possible to reduce the motor input of the first compressor because while suppressing decrease in power collected by the expander and in pressure that compresses the refrigerant in the second compressor, the pressure that compresses the refrigerant in the first compressor can be lowered, therefore, a refrigerating cycle apparatus can be provided capable of achieving energy saving.

REFERENCE SIGNS LIST

Figure 1:
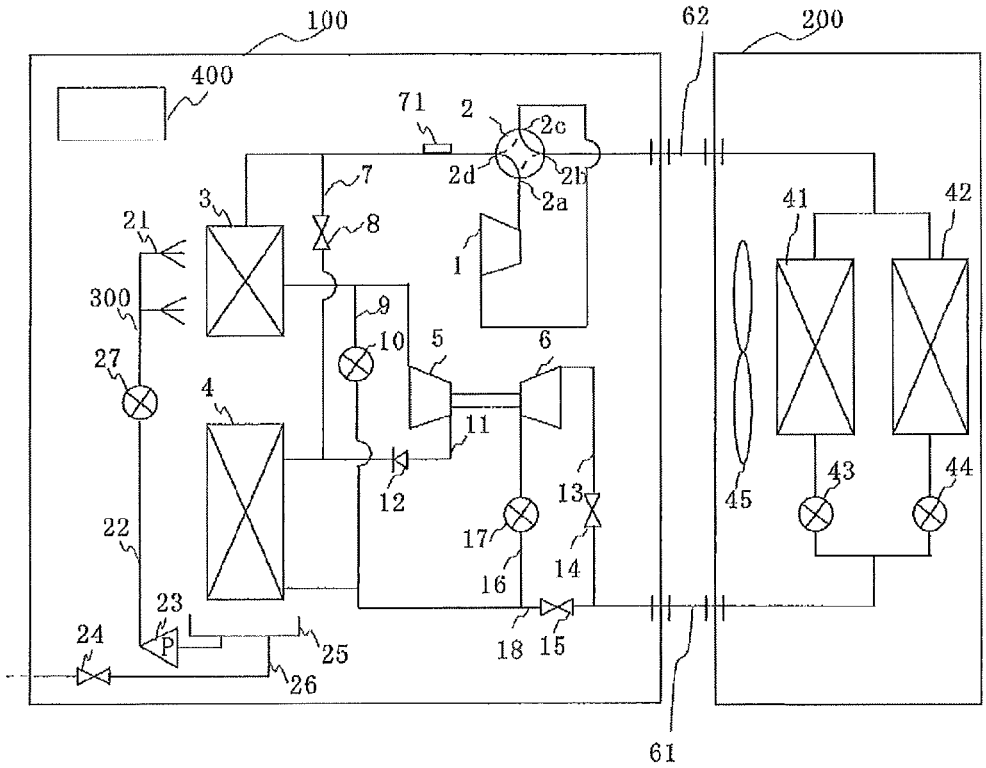
FIG. 1 is a refrigerant circuit diagram of the refrigerating cycle apparatus according to Embodiment 1.

1 first compressor
2 four-way valve
3 intercooler
4 main radiator
5 second compressor
6 expander
7, 9 piping
8, 14, 15, 24 opening and closing valve
10, 17, 43, 44 electronic expansion valve
11, 13 discharge piping
12 check valve
16 suction piping
18 bypass piping
21 water spray nozzle
22 water spray piping
23 pump
25 drain pan
26 water-supply pipe
27 flow rate adjustment valve
41, 42 indoor heat exchanger
45 indoor blower
61, 62 piping
71 temperature sensor
100 outdoor unit
200 indoor unit
300 water spray apparatus
400 control apparatus

DESCRIPTION OF EMBODIMENTS

Embodiment 1

Descriptions will be given to the refrigerating cycle apparatus according to Embodiment 1 of the present invention as follows.

FIG. 1 is a pattern diagram of the refrigerating cycle apparatus according to Embodiment 1. In the present embodiment, descriptions will be given to the case where the refrigerating cycle apparatus is applied to an air conditioning apparatus capable of performing cooling and heating operations. In FIG. 1, the refrigerating cycle apparatus according to the present embodiment includes an outdoor unit 100, which is a heat source side unit, and an indoor unit 200, which is a load side unit. Each means constituting the outdoor unit 100 and the indoor unit 200 is piping-connected by piping 61 and 62 and the refrigerant circuit is configured. In the refrigerant circuit, carbon dioxide is encapsulated as the refrigerant, which is a natural refrigerant to be a supercritical state at a critical temperature (approximately 31 degrees C.) or over, for example. However, the refrigerant is not limited to the carbon dioxide but may be a refrigerant to be a super critical state in particular. Here, high or low pressure in the refrigerant circuit is not determined by the reference pressure but represented as a relative pressure created by such as the compression (pressurization) by the compressor and decompression by the refrigerant flow amount control. It is the same as the high or low temperature.

The outdoor unit 100 of the present embodiment includes a first compressor 1 for compressing and pressurizing the gas refrigerant. The four-way valve 2 switches refrigerant flow paths at the time of cooling and heating operations based on the command from the control apparatus 400. A first port 2*a* of the four-way valve 2 is connected with the discharge side of the first compressor 1, a fourth port 2*d* with one end of the intercooler 3, a third port 2*c* with the inlet side of the first compressor, and a second port 2*b* with one end of piping 62 leading to the indoor unit 200, respectively.

The intercooler 3 and the main radiator (gas cooler) 4 become a heat source side heat exchanger. In particular, at the time of cooling operation, the intercooler 3 is located at the front stage (an upstream side to the refrigerant flowing direction) of the second compressor 5 and the main radiator 4 at the back stage (a downstream side to the refrigerant flowing direction) thereof to cool the refrigerant through heat exchange with the outdoor air, for example. On the other hand, at the time of heating operation, the intercooler 3 and the main radiator 4 become piping connection in series and are functionally integrated to evaporate the refrigerant. Here, in the present embodiment, the intercooler 3 is located at the upper side and the main radiator 4 on the downside to the vertical direction, respectively in the outdoor unit 100. Therefore, as mentioned later, by spraying water onto the intercooler 3, which is at the upper part (refrigerant inlet side at the time of cooling operation) of the heat source side heat exchanger, the water spray is mainly directed to the intercooler 3, causing part of the sprayed water to drop onto the main radiator 4 to be sprayed. Resultantly, in the present embodiment, water is sprayed onto the intercooler 3 and the main radiator 4.

The expander 6 decompresses the refrigerant to turn it into gas-liquid two phase state humid vapor. Then, in the decompression process, the internal energy owned by the refrigerant is collected as power. The second compressor 5 is coaxially connected with the expander 6 to be driven by the power collected by the expander 6. The suction piping 16 is piping to introduce the refrigerant cooled by the main radiator 4 to the expander 6. The electronic expansion valve 17 is free to change opening to be means to decompress the refrigerant passing through the suction piping 16.

The discharge piping 13 is piping to introduce the refrigerant flowing out from the expander 6. The opening and closing valve 14 is means to pass and interrupt the refrigerant in the discharge piping 13. The discharge piping 11 is piping to introduce the refrigerant discharged by the second compressor 5 to the main radiator 4. The check valve 12 is provided to define the direction of the refrigerant flowing through the discharge piping 11. The piping 9 is piping to introduce the refrigerant to intercooler 3 at the time of heating operation. The electronic expansion valve 10 is free to change opening to be means to decompress the refrigerant passing through the piping 9.

The piping 7 guides the refrigerant evaporated in the main radiator 4 at the time of heating operation to the suction side of the first compressor 1. The opening and closing valve 8 is means to pass and interrupt the refrigerant in the piping 7. The bypass piping 18 is piping to bypass the refrigerant to the expander 6 instead of passing therethrough at the time of heating operation. The opening and closing valve 15 is means to pass and interrupt the refrigerant in the bypass piping 18. A blower, not shown in particular, may be provided to compulsorily blow outside air to the outer surface of the intercooler 3 and main radiator 4. Thereby, water spray by the water supply apparatus 30 is made not to be interrupted.

The indoor unit 200 includes indoor heat exchangers 41 and 42, which are the load side heat exchanger, to perform heat exchange between the heat exchange object and the refrigerant. The indoor unit 200 further includes electronic expansion valves 43 and 44 that is means to adjust refrigerant amount made to pass through the indoor heat exchangers 41 and 42 and to decompress the refrigerant. One ends of the indoor heat exchangers 41 and 42 are integrated and connected with the outdoor unit 100 via piping 62. The other terminals are integrated and connected with the outdoor unit 100 via piping 61. Here, in the present embodiment, there are two indoor heat exchangers 41 and 42 to configure the indoor unit 200, however, one or three or more indoor heat exchangers are allowable. A blower may be provided to compulsorily blow the indoor air onto the outer surface of the indoor heat exchangers 41 and 42.

A water spray apparatus 300 is provided with the outdoor unit 100 to be means to spray water to the upper part of the outer surface of the heat source side heat exchanger (the intercooler 3 and the main radiator 4) only at the time of cooling operation. In the present embodiment, the water spray apparatus 300 is constituted by the water spray nozzle 21, water spray piping 22, pump 23, opening and closing valve 24, drain pan 25, water-supply pipe 26, and flow rate adjustment valve 27.

The drain pan 25 stores water for spraying and installed for collecting water that is not evaporated on the outer surface of the intercooler 3 and the main radiator 4.

The water-supply pipe 26 is piping to supply water with the drain pan 25. The opening and closing valve 24 is means to pass and interrupt the water in the water-supply pipe 26. The bottom part of the drain pan 25 is opened and connected with one end of the water-supply pipe 26. Here, the drain pan 25 is provided with, for example, a water level detector, not shown, and the control apparatus 400 judges a water level based on the detection of the water level detector. When the water level is judged to be lower than a predetermined lower limit, the opening and closing valve 24 is opened and water is supplied with the drain pan 25. On the other hand, when the water level is judged to be higher than a predetermined upper limit, the opening and closing valve 24 is closed and water supply is stopped.

Figure 2:
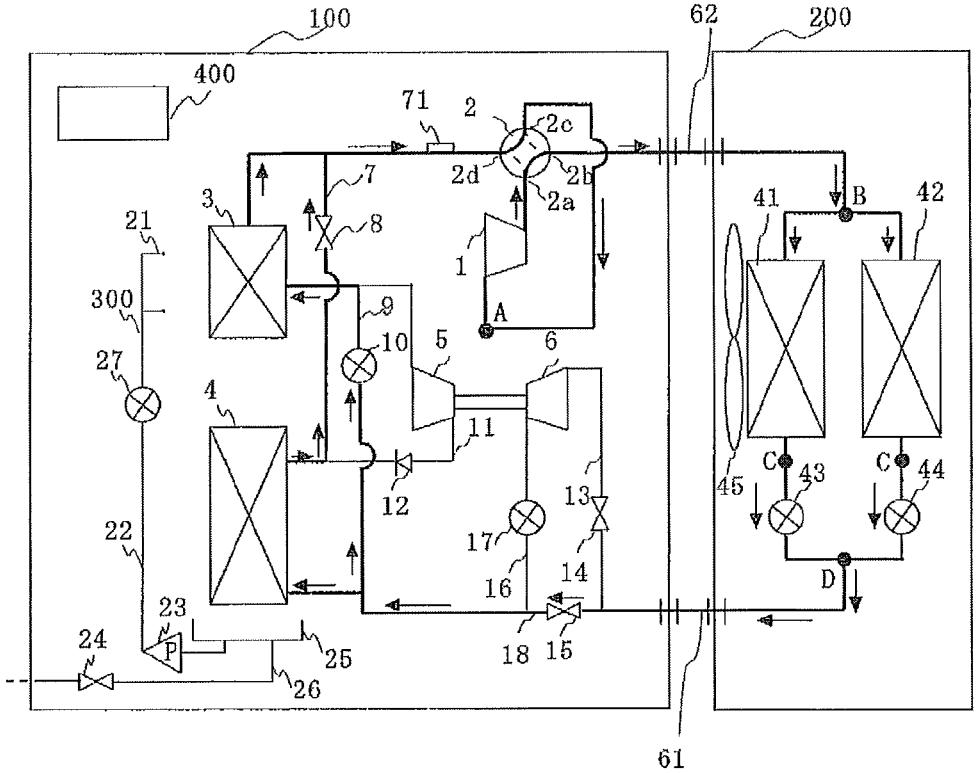
FIG. 2 is the refrigerant circuit diagram showing the refrigerant flow at the time of heating operation of the apparatus of Embodiment 1.
Figure 3:
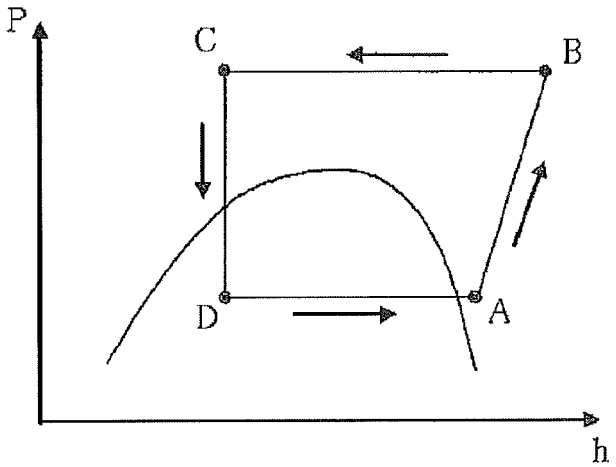
FIG. 3 is a P-h diagram showing a state of the refrigerant at the time of heating operation of the apparatus of Embodiment 1.

The water spray pipe 22 supplies water with the water spray nozzle 21 to spray water at the upper part on the outer surface of the heat source side heat exchanger (the intercooler 3 and the main radiator 4). The pump 23 pressure-feeds water stored in the drain pan 25 to the water spray nozzle 21 via the water spray piping 22. The bottom part of the drain pan 25 is opened and connected with one end of piping at the suction side of the pump 23. The flow rate adjustment valve 27 adjusts the amount of water supplied with water spray nozzle 21. The opening of the flow rate adjustment valve 27 is changed by the control apparatus 400 according to the temperature detected by the temperature sensor 71 that detects the discharge temperature of the first compressor 1, Descriptions will be given to operation action of the refrigerating cycle apparatus configured like above based on the circulation of the refrigerant. FIG. 2 is a diagram showing the circulation path of the refrigerant at the time of heating operation, FIG. 3 is a P-h diagram showing conditions of the refrigerant at the time of heating operation.

At the time of heating operation, the control apparatus 400 switches the four-way valve 2 owned by the outdoor unit 100 such that the first port 2*a* and the second port 2*b* are communicated and the fourth port 2*d* and the third port 2*c* being communicated. (Solid line in FIG. 2) The opening and closing valves 15 and 8 are opened, the electronic expansion valve 10 being fully opened, and the electronic expansion valve 17 in the suction piping 16 is completely closed. Further, the check valve 12 and opening and closing valve 14 are closed. Here, since no water is sprayed during heating operation, the pump 23 of the water spray apparatus 300 is stopped.

Under such conditions, the high temperature gas refrigerant (state B) discharged by the first compressor 1 flows into the indoor unit 200 from the first port 2*a* of the four-way valve 2 through the second port 2*b* and through the piping 62. Then, the high temperature gas refrigerant flowed into the indoor heat exchangers 41 and 42 of the indoor unit 200 radiates heat to the indoor air, which is medium to be heated (heat exchange object) delivered into the indoor heat exchangers 41 and 42 by the indoor blower 45. The heated indoor air by the heat radiation of the refrigerant heats indoors, which is a subject space to be air-conditioned.

On the other hand, the refrigerant that radiated heat in the indoor heat exchangers 41 and 42 is cooled and liquefied to turn into a low temperature refrigerant (state C). Further, the refrigerant is decompressed by the electronic expansion valves 43 and 44 to turn into a low-pressure low-temperature gas-liquid two phase refrigerant (state D) to flow into the outdoor unit 100 after passing through the connected piping 61.

The gas-liquid two phase refrigerant flowed into the outdoor unit 100 flows into the intercooler 3 via the main radiator 4 and the electronic expansion valve 10 after passing through the opening and closing valve 15. The gas-liquid two phase refrigerant flowed into the main radiator 4 performs heat exchange with the outdoor air and absorbs heat therefrom to evaporate and gasify. The low-pressure gas refrigerant flowed out from the main radiator 4 passes through the opening and closing valve 8 to flow into the fourth port 2*d* of the four-way valve 2. On the other hand, the gas-liquid two phase refrigerant flowed into the intercooler 3 evaporates and gasifies to join with the low-pressure gas refrigerant flowed out from the main radiator 4. The gas refrigerant (state A) passed through the four-way valve 2 returns to the suction side of the first compressor 1.

Figure 4:
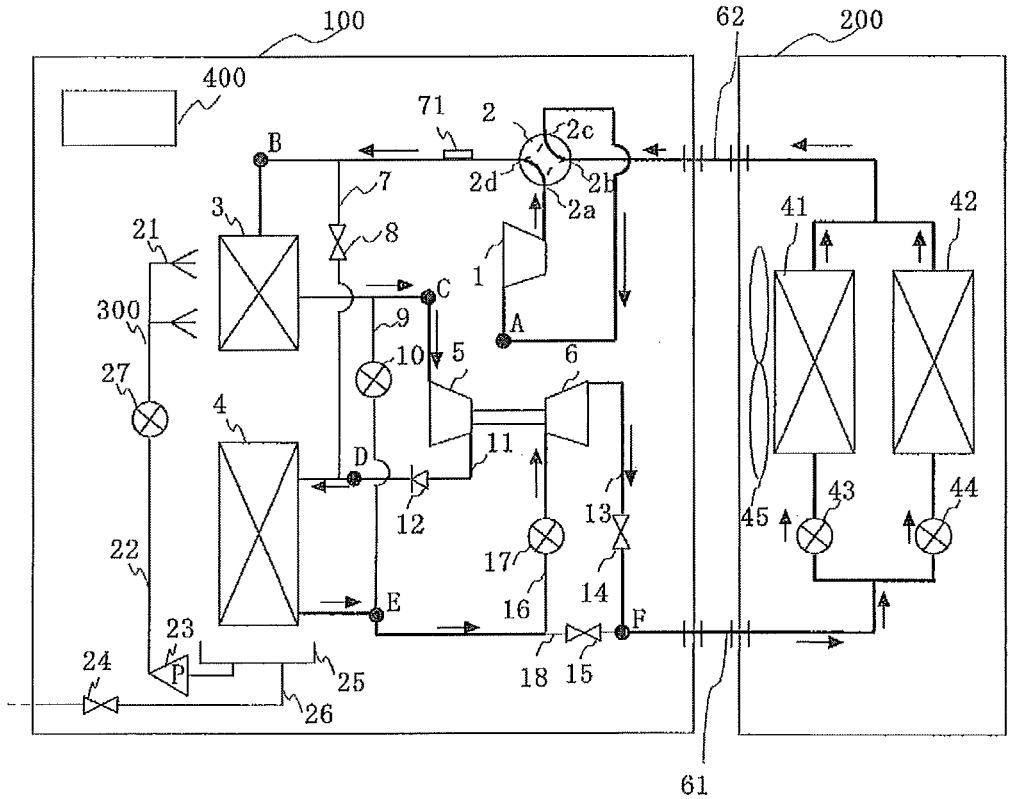
FIG. 4 is the refrigerant circuit diagram showing the refrigerant flow at the time of cooling operation of the apparatus according to Embodiment 1.
Figure 5:
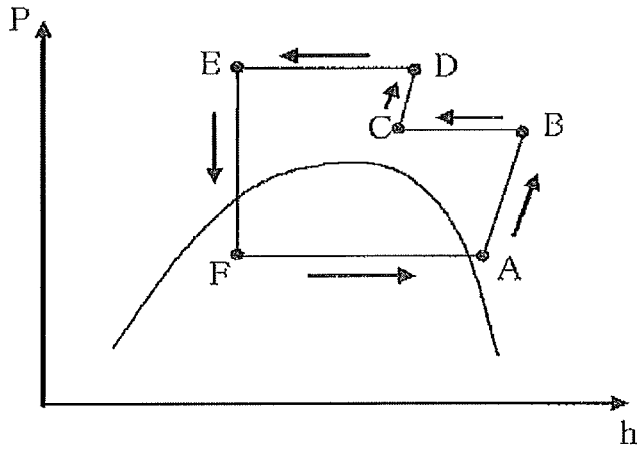
FIG. 5 is a P-h diagram showing a state of the refrigerant at the time of cooling operation of the apparatus of Embodiment 1.

FIG. 4 is a diagram showing the circulation path of the refrigerant at the time of the cooling operation. FIG. 5 is a P-h diagram showing a state of the refrigerant at the time of cooling operation. Next, descriptions will be given to a case where cooling operation is performed.

In the case of the cooling operation, the control apparatus 400 switches the four-way valve 2 owned by the outdoor unit 100 such that the first port 2*a* and the fourth port 2*d* are communicated and the third port 2*c* and the second port 2*b* being communicated. (solid line in FIG. 4) The opening and closing valves 15 and 8 are closed, the electronic expansion valve 10 being completely closed. Further, the check valve 12 and opening and closing valve 14 are opened. At the time of cooling operation, since water is sprayed according to circumstances, the pump 23 of the water spray apparatus 300 is prepared to be driven.

Under such conditions, the high-temperature medium-pressure gas refrigerant (state B) discharged from the first compressor 1 passes from the first port 2*a* through the fourth port 2*d* of the four-way valve 2. The refrigerant (state C) flowed into the intercooler 3 and whose temperature decreased a little by radiating heat to the medium to be heated is absorbed by the second compressor 5. The refrigerant discharged by the second compressor 5 driven by the power collected by the expander 6 is boosted to a higher pressure than the pressure discharged by the first compressor 1. The high-temperature high-pressure refrigerant (state D) boosted by the second compressor 5 passes through the check valve 12 and radiates heat to the medium to be heated in the main radiator 4 as well to be cooled and liquefied (state E).

Here, in the case of cooling operation, the water of the by the water spray apparatus 300 as well as the air are made to be the medium to be heated to perform heat exchange with the refrigerant in the intercooler 3 and the main radiator 4. The water spray apparatus 300 sprays water on the outer surface of the intercooler 3. Accordingly, the sprayed water onto the outer surface of the intercooler 3 which is upper side of the main radiator 4 is heated by the refrigerant to evaporate by adopting the heat quantity as evaporative latent heat. As a result, in the intercooler 3, the refrigerant radiates heat to both the air, which is the medium to be heated, and the sprayed water. The water that drops as liquid droplets without evaporating by the heating of the refrigerant in the intercooler 3 drops onto the main radiator 4 to partly evaporate because of heating of the refrigerant in the main radiator 4. The water that did not evaporate in the main radiator 4 drops onto the drain pan 25.

On the other hand, the liquid refrigerant cooled in the main radiator 4 passes through the electronic expansion valve 17 to flow into the expander 6 and decompressed by the expander 6 to turn into the humid vapor refrigerant (state F) of the gas-liquid two phase state. Thereby, in the expander 6, internal energy of the refrigerant related to decompression is collected to be transformed so as to be power of the second compressor 5.

The two phase refrigerant decompressed by the expander 6 passes through the opening and closing valve 14 and the connected piping 61 to flow into the indoor unit 200. The two phase refrigerant flowed into the indoor unit 200 is almost uniformly distributed in each indoor heat exchanger 41 and 42 by the electronic expansion valves 43 and 44. The gas-liquid two phase refrigerant flowed into the indoor heat exchangers 41 and 42 absorbs heat from the indoor air, which is the medium to be heated (heat exchange object)delivered into the indoor heat exchangers 41 and 42 by the indoor blower 45. The indoor air cooled by heat absorption cools indoor, which is an air conditioning object space.

The low-temperature low-pressure refrigerant flowed out and joined from the indoor heat exchangers 41 and 42 passes through the connected piping 62 to flow into the outdoor unit 100. In the outdoor unit 100, the refrigerant returns to the suction side of the first compressor 1 via the second port 2*b* to the third port 2*c* of the four-way valve 2.

Figure 6:
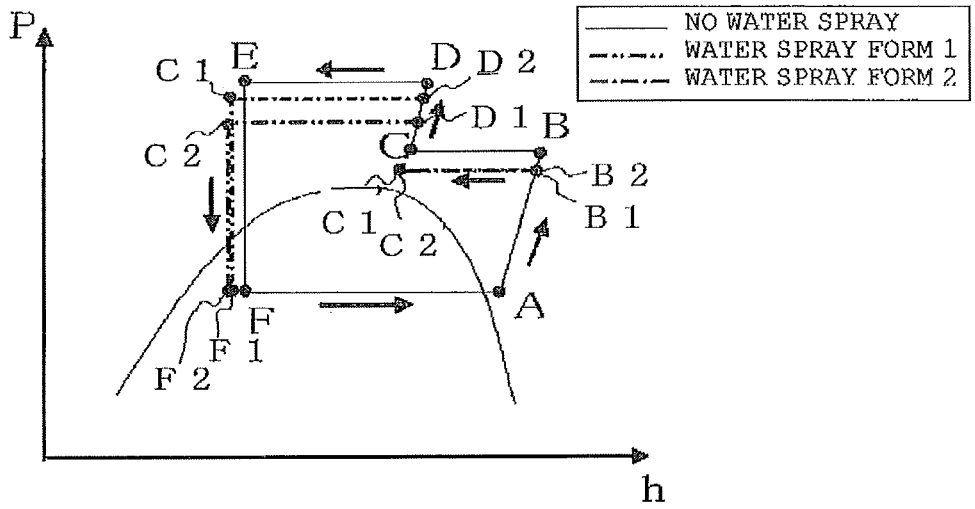
FIG. 6 is a P-h diagram showing comparison of water spray form in the refrigerating cycle apparatus.

FIG. 6 is a diagram showing a P-h diagram for comparing states of cases where no water is sprayed from the water spray apparatus 300 (no water spray), water is sprayed on all over the outer surface of the intercooler 3 and the main radiator 4 (water spray form 1), and water is sprayed on the outer surface of the heat source side heat exchanger (the intercooler 3 and the main radiator 4) (water spray form 2).

In the above-mentioned refrigerating cycle apparatus, water is sprayed on the outer surface of the heat source side heat exchanger (the intercooler 3 and the main radiator 4) by the water spray apparatus 300 at the time of cooling operation. In the present embodiment, it is possible to improve COP at the time of cooling operation by enhancing the cooling effect of the refrigerant in the intercooler 3 in particular.

For example, in the case where no water is sprayed onto the intercooler 3 and the main radiator 4 (no water spray), the refrigerant transits from the state of A to the state of B (8.6 MPa, for example) by the compression of the first compressor 1 to be the state of C by the radiation in the intercooler 3. Here, the refrigerant temperature at C is determined by the outdoor air temperature, which is the object to be heated, and the radiation ability ratio of the intercooler 3 with the main radiator 4. When the outdoor air temperature is set at approximately 35 degrees C. (the outdoor air temperature in summer, in general) and the radiation ability ratio of the intercooler 3 to the main radiator 4 is set at 1:1, the refrigerant temperature at C becomes approximately 40 degrees C. Thereafter, the refrigerant turns into the state of D (9.5 MPa, for example) by the compression of the second compressor 5 which is driven by the power collected by the expander 6 to turn into the state of E by the radiation of the main radiator 4.

On the other hand, in the case where water is sprayed on all over the outer surface of the intercooler 3 and the main radiator 4 (water spray form 1), the radiation effect of the refrigerant is improved by the heat absorption of the water by the water spray apparatus 300 as evaporative latent heat in all of the intercooler 3 to the main radiator 4. The refrigerant turns from the state of A to the state of B1 (7.7 MPa, for example) by the compression of the first compressor 1, then into the state of C1 by the radiation by the intercooler 3. Here, since water is sprayed on the intercooler 3, the pressure of the refrigerant for cooling becomes low. The pressure for cooling the intercooler 3 is referred to as an intermediate pressure. Thereafter, the refrigerant turns into the state of D (8.1 MPa, for example) by the compression of the second compressor 5, then into the state of E1 by the radiation by the main radiator 4 as well. Here, the pressure for cooling by the water spray effect becomes low in the main radiator 4. The pressure for cooling the main radiator 4 is referred to as a high pressure.

Next, in the case where water is sprayed onto the outside surface of the heat source side heat exchanger (the intercooler 3 and the main radiator 4) (water spray form 2), the radiation effect is enhanced especially in the intercooler 3. The refrigerant turns from the state of A to the state of B2 (7.7 MPa, for example) by the compression by the first compressor 1, then into the state of C2 by the radiation in the intercooler 3. Here, the intermediate pressure becomes low because water is sprayed onto the intercooler 3 as well. Thereafter, the refrigerant turns into the state of D2 (8.6 MPa, for example) by the compression of the second compressor 5, then into the state of E2 by the radiation in the main radiator 4. Thus, while the pressure with spraying water becomes lower than the pressure with no water spray in the main radiator 4, the degree of lowering becomes smaller compared with the water spray form 1 where water is sprayed onto the entire outer surface of the heat source side heat exchanger (the intercooler 3 and the main radiator 4).

Figure 7:
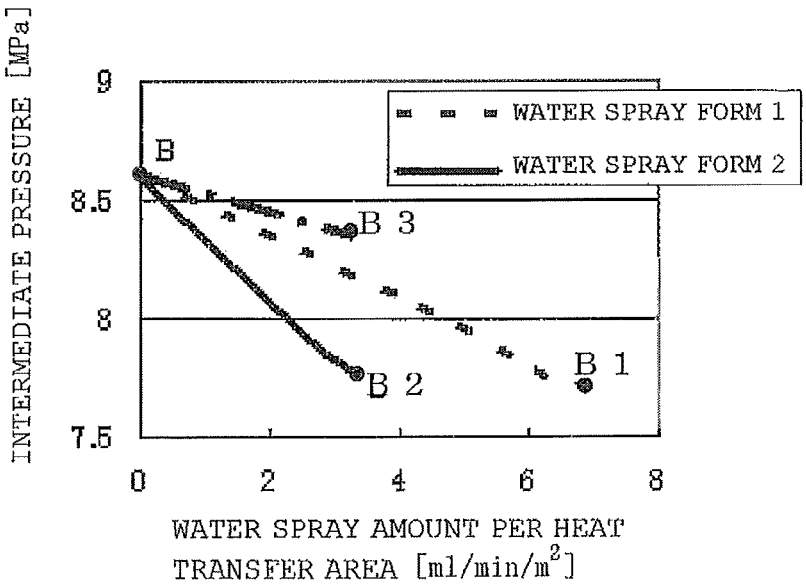
FIG. 7 is a diagram showing a relation between a water spray amount Qw per heat transfer area and an intermediate pressure.

FIG. 7 is a diagram showing a relation between a water spray amount Qw per heat transfer area and an intermediate pressure of the intercooler 3 and the main radiator 4. Points B, B1, and B2 shown in FIG. 7 corresponds to B, B1, and B2 in FIG. 6, respectively.

In FIG. 7, the water spray amount Qw at B1 is approximately 6.8 ml/min/$m^2$ in the water spray form 1 and the intermediate pressure then is approximately 7.7 MPa. On the other hand, the water spray amount Qw at B2 is approximately 3.4 ml/min/$m^2$ in the water spray form 2 and the intermediate pressure then is approximately 7.7 MPa. That shows that even if the water spray amount per heat transfer area of the water spray form 2 is approximately halved compared with the water spray form 1, the intermediate pressures become almost equal. Accordingly, the water spray amount onto the intercooler 3 is made larger than that of the main radiator 4, the intermediate pressure does not change.

Figure 8:
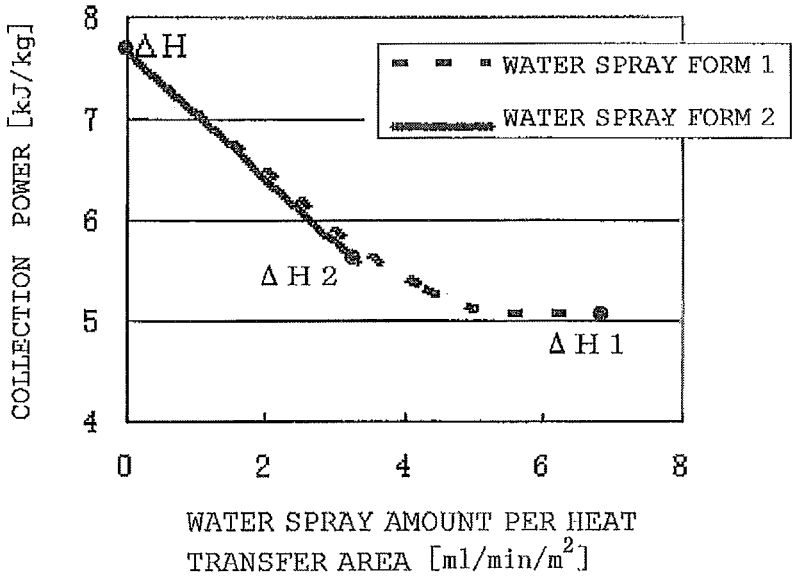
FIG. 8 is a diagram showing a relation between a water spray amount Qw per heat transfer area and a collection power of the expander 6.

FIG. 8 is a diagram showing a relation between a water spray amount Qw per heat transfer area and a collection power by the expander 6. In FIG. 8, delta H denotes the collection power at the operation point of the expander 6 in the case of no water spray, delta H1 denotes the same in the case of the water spray form 1, and delta H2 denotes the same in the case of the water spray form 2.

As shown in FIG. 8, compared with the collection power delta H in the case of no water spray, as the water spray amount Qw per heat transfer area of the main radiator 4 increases, the collection power is lowered. This is because as the heat amount to be radiated increases in the main radiator 4, the pressure of the higher pressure side is lowered and the pressure difference in the expander 6 (E-F, for example) becomes small. With the water spray forms 1 and 2, since the radiation effect by the water spray of the main radiator 4 is higher in the water spray form 1, the pressure of the higher pressure side is lowered to be delta H2>delta H1, The pressure rising amount (D-C, for example) by the second compressor 5 is in proportion to the collected power by the expander 6, which is the driving force.

From the above, since there is almost no difference in the intermediate pressure of water spray forms 1 and 2, like the water spray form 2, the radiation effect of the main radiator 4 is made to be small by making the water spray amount Qw per heat transfer area of the main radiator 4 to be almost half of the water spray form 1, and by making the water spray amount Qw per heat transfer area to be smaller than the intercooler 3. Thereby, compared with the water spray form 1, the lowering of the collection power of the expander 6 can be made small, and the decrease in the pressure rising amount by the second compressor 5 can be made small.

Here, the intermediate pressure and the high pressure are defined by the balance between the condensation ability in the intercooler 3 and the main radiator 4 and the pressure rising amount in the second compressor 5. In the water spray form 2, since the water spray amount in the main radiator 4 becomes smaller than that of the water spray form 1, the ability to cool the refrigerant in the main radiator 4 is lowered. However, the pressure rising amount of the second compressor 5 becomes large, therefore, the intermediate pressure in the intercooler 3 becomes almost equal in the water spray forms 1 and 2.

When trying to enhance the radiation effect of the main radiator 4 by spraying water only at the lower part of the outer surface of the intercooler 3 and the main radiator 4, no radiation effect can be obtained by the water spray in the intercooler 3. Since the collection drive force is lowered due to the decrease in the to pressure of the higher pressure side, the intermediate pressure increases as shown by 133 of FIG. 7.

As mentioned above, according to the refrigerating cycle apparatus of Embodiment 1, the water spray apparatus 300 sprays water on the intercooler 3, therefore, the discharge pressure (intermediate pressure) of the first compressor 1 can be decreased much less than the case of no water spray, allowing to lower the input of the motor of the first compressor 1. The refrigerant can be effectively cooled as well. On the other hand, the water spray amount per heat transfer area in the main radiator 4 is made to be smaller than the water spray amount in the intercooler 3, therefore, while compensating the cooling ability of the refrigerant in the main radiator 4 by the cooling in the intercooler 3, the collection drive force in the expander 6 can be enhanced, allowing to make the decrease in the pressure rising amount by the second compressor 5 to be small. Resultantly, COP can be improved as the entire refrigerating cycle apparatus.

With the present embodiment, by spraying water at the upper portion of the outer surface of the intercooler 3 and the main radiator 4 in the water spray apparatus 300, the same effect can be obtained as when spraying water onto the entire outer surface of the intercooler 3 and the main radiator 4, allowing to decrease in use amount of the water necessary for spraying.

According to the refrigerating cycle apparatus of the present embodiment, since water use amount by the water spray apparatus 300 can be lowered, the drive force consumed in the pump 23 of the water spray apparatus 300 can be lowered, allowing to decrease in the electric power use amount of the refrigerating cycle apparatus and to expect to improve, for example, COP and the like at the time of cooling operation.

According to the refrigerating cycle apparatus of the present embodiment, the opening of the flow rate adjustment valve 27 of the water spray apparatus 300 is adjusted by the discharge temperature sensor 71 of the first compressor 1. Therefore, water spray amount onto the intercooler 3 is adjusted so that the intermediate pressure according to the discharge temperature can be obtained, allowing to maintain the collection drive force by the expander 6. Thereby, COP at the time of cooling operation can be improved.

According to the refrigerating cycle apparatus of the present embodiment, since water use amount by the water spray apparatus 300 can be reduced, the pump 23 can be omitted by spraying water using the water pressure brought by the tap water without using the pump 23 of the water spray apparatus 300. Thereby, electric power use amount can further be reduced. Using carbon dioxide, which is a natural refrigerant, as the refrigerant, burden to the environment can be reduced because no chlorofluorocarbon is used.

Embodiment 2

Besides the above-mentioned Embodiment 1, followings can be used to the present invention.

For example, in Embodiment 1, the intercooler 3 is configured to be an upper step and the main radiator 4 a lower step. However, the intermediate pressure may be reduced by disposing the main radiator 4 at the upper step, the intercooler 3 the lower step and making water to be sprayed at the lower portion of the intercooler 3 and the main radiator 4. The intercooler 3 and the main radiator 4 may be disposed in parallel by making the intercooler 3 to be the outside of the water spray and the main radiator 4 to be the inside. When performing such arrangement, water is sprayed only onto the intercooler 3.

In Embodiment 1, based on the discharge temperature sensor 71 of the first compressor 1, the control apparatus 400 is adapted to adjust the opening of the flow rate adjustment valve 27 of the water spray apparatus 300. However, it is not limited thereto, but sensors (detection means) may be provided that detect such as refrigerant pressure discharged by the first compressor 1, suction temperature of the refrigerant in the second compressor 5, and suction pressure in the second compressor 5. The water spray amount of the water spray apparatus 300 may be adjusted based on the physical quantity values related to these sensors.

In Embodiment 1, the intermediate pressure is set at approximately 7.7 MPa. However, the pressure signifies a preferable intermediate pressure in particular, and the intermediate pressure is not limited thereto. It may be 8.5 MPa, for example.

In Embodiment 1, the refrigerant is made to flow into the expander 6 to collect power only at the time of cooling operation, however, it is not limited thereto. Power may be collected by the expander 6 at the time of heating operation as well.

INDUSTRIAL APPLICABILITY

As explained above, the present invention is effective for the refrigerating cycle apparatus having a refrigeration circuit that compresses the refrigerant up to a supercritical state to perform a refrigeration cycle. In the above embodiments, descriptions are given to the case of employing the refrigerating cycle apparatus for the air conditioning apparatus, however, it can be employed for a refrigerating apparatus that cools inside of a cold storage warehouse.

The invention claimed is:

1. A refrigerating cycle apparatus, comprising:

a first compressor that compresses a refrigerant;

an expander that decompresses and expands the refrigerant to collect power for expansion;

a second compressor that is driven by the power collected by said expander to further compresses the refrigerant compressed by said first compressor;

a heat source side heat exchanger having an intercooler that cools the refrigerant compressed by said first compressor and a main radiator that cools the refrigerant compressed by said second compressor to transmit the same to said expander;

an evaporator that heats the refrigerant decompressed by said expander;

a water spray apparatus for spraying water onto the outer surface of said intercooler and said main radiator; and a controller configured to control the water spray apparatus to adjust an amount of the water, and a four-way valve that switches refrigerant flow paths at a time of a cooling operation and a time of a heating operation, wherein in a refrigerant flow path direction, at the time of the cooling operation, said intercooler and said main radiator are connected in series, said second compressor is located between said intercooler and said main radiator, said intercooler is located at a front stage of said second compressor and said main radiator is located at a back stage of said second compressor, at the time of the heating operation, said intercooler and said main radiator are connected in parallel, said water spray apparatus arranged to sprays water only onto the outer surface of said intercooler provided upstream of said main radiator and, sprayed water that does not evaporate on said intercooler dropping onto said main radiator, and said controller is further configured to control said water spray apparatus so that a water spray amount per heat transfer area of said intercooler is greater than a water spray amount per heat transfer area of said main radiator, and so that a collection drive force by said expander is maintained based on a temperature of the refrigerant discharged from said first compressor.

2. The refrigerating cycle apparatus of claim 1, wherein said refrigerant contains carbon dioxide.

3. An air conditioning apparatus including the refrigerating cycle apparatus of claim 1, comprising:

an indoor unit that has said evaporator, and that performs the cooling operation or heating operation of an air conditioning object space, and an outdoor unit that has said first compressor, said expander, said second compressor, intercooler, said main radiator, and said water spray apparatus, and that circulates said refrigerant to feed heat quantity for making said indoor unit to perform said cooling or heating operation.

4. The air conditioning apparatus of claim 3, wherein heat exchange is performed separately in the intercooler and in the main radiator by driving the second compressor only at the time of the cooling operation.

5. The air conditioning apparatus of claim 3, wherein water is sprayed from said water spray apparatus only at the time of the cooling operation.

6. The air conditioning apparatus of claim 4, wherein water is sprayed from said water spray apparatus only at the time of the cooling operation.

* * * * *